US005603538A

United States Patent [19]

Evers

[11] Patent Number: 5,603,538

[45] Date of Patent: Feb. 18, 1997

[54] CASEMENT WINDOW SASH LOCKING SYSTEM

[75] Inventor: Robert S. Evers, Pella, Iowa

[73] Assignee: Pella Corporation, Pella, Iowa

[21] Appl. No.: 371,753

[22] Filed: Jan. 12, 1995

[51] Int. Cl.[6] ..... E05C 3/06

[52] U.S. Cl. ..... 292/215; 292/54; 292/46

[58] Field of Search ..... 292/215, 45–49, 292/51, 54, 33, 3, 11, DIG. 20, DIG. 35, DIG. 47, 241, 240

[56] References Cited

U.S. PATENT DOCUMENTS

| | | | |
|---|---|---|---|
| 1,794,171 | 2/1931 | Grutel | 292/46 X |
| 3,238,898 | 3/1966 | Floehr . | |
| 3,240,165 | 3/1966 | Floehr . | |
| 3,328,062 | 6/1967 | Geiger et al. | 292/242 |
| 3,500,038 | 2/1971 | Gunther . | |
| 4,059,298 | 11/1977 | Van Klompenburg . | |
| 4,253,688 | 3/1981 | Hosooka | 292/241 X |
| 4,429,910 | 2/1984 | Anderson . | |
| 4,610,472 | 9/1986 | Billingsley . | |
| 4,803,808 | 2/1989 | Greisner | 292/DIG. 20 X |
| 4,973,091 | 11/1990 | Paulson | 292/51 |
| 5,080,407 | 1/1992 | Evers . | |
| 5,087,087 | 2/1992 | Vetter et al. | 292/DIG. 47 X |
| 5,172,944 | 12/1992 | Munich et al. . | |

FOREIGN PATENT DOCUMENTS

| | | | |
|---|---|---|---|
| 399945 | 4/1966 | Switzerland | 292/46 |
| 438077 | 11/1967 | Switzerland | 292/46 |
| 2101673 | 1/1983 | United Kingdom | 292/46 |

OTHER PUBLICATIONS

Copy of Design News magazine, p. 167, dated Jul. 5, 1993 for Southco, Inc.

*Primary Examiner*—Rodney M. Lindsey
*Assistant Examiner*—Monica E. Millner
*Attorney, Agent, or Firm*—Zarley, McKee, Thomte, Voorhees, & Sease

[57] ABSTRACT

A casement sash locking system including locking assembly, drive assembly and lock strike that can be mounted on either side allowing the window to open from the left side or right side. The locking assembly includes a lock catch that functions to first lift the outer free end of the sash and then pull the sash to a closed position, thereby preventing drag of the sash on the window frame sill.

21 Claims, 8 Drawing Sheets

CASEMENT WINDOW SASH LOCKING SYSTEM

BACKGROUND OF THE INVENTION

Casement windows are hinged on one vertical edge to the jamb of a window frame allowing the opposite vertical edge to swing outwardly from the window frame. These kinds of windows, while having many attractive features, do present certain problems. The outer free vertical edge of the sash may drop over a period of time since it is cantilevered from the hinged window jamb, thereby causing drag when the sash is closed against the window frame sill.

Typically the casement type window will involve a locking assembly on the jamb adjacent the free edge of the sash, but the locking assembly will oftentimes be too high to be readily reached when windows are over sinks, counters, etc.

A related problem is that ideally the window should be capable of being deactivated for security reasons.

The locking systems typically used are limited in application due to the substantial space required for the locking mechanism.

Thus, it is seen that a locking system for casement windows is needed that will obviate any sash drag that might otherwise occur, occupy a minimum of space, be readily accessible and include security protection.

SUMMARY OF THE INVENTION

The window locking system of this invention includes a catch engageable with a lock strike on the sash which functions to move between first and second positions. In the first position the catch extends outwardly and downwardly from the window jamb, and in moving to the second position pivots upwardly into engagement with the lock strike on the sash, thereby lifting the outer free edge of the sash such that it will clear the windowsill when the sash is moved to its closed position. The catch, after having lifted the sash, then continues towards the second position by pulling the sash toward the window frame to the fully-closed position.

The preferred embodiment includes upper and lower locking assemblies and a drive assembly, including a handle located on the jamb below both locking assemblies, thereby making it readily accessible at the level of the windowsill.

The lock strike is recessed into the outer free vertical edge of the sash and includes a housing having interior lock or strike shoulders on opposite sides of an access opening. The lock strike housing can be mounted on either vertical edge of the sash with one strike shoulder being utilized on one side and the other being used on the other side. The locking assembly and the drive assembly can be mounted on either jamb as most of the component parts of each are compatible to operation in either location.

The drive assembly includes a rotatable cam which is removably connected to a handle whereby for security purposes the handle may be removed rendering the locking assembly inoperative. In U.S. Pat. No. 5,080,407, REMOVABLE LOCKING LEVER FOR A CASEMENT WINDOW, a handle is shown removably attached to a different kind of cam.

The design of the components of the drive assembly and locking assembly are such that they can be mounted in the window jamb where space available is at a minimum. Drive and locking assemblies are hidden under a very thin frame stop. The frame stop is a 4/4(0.688 inch) as compared to previous frame stops which are 5/4(1.093 inch).

The lock strike has an edge that seals against the primary weatherstrip to provide an air and water seal. The lock strike edge is coincident with the sash edge to form a continuous seal. The lock strike design in cooperation with the lock catch enables the lock catch to have a minimum clearance with the weatherstrip. The lock catch width is unique for casement windows in that it is only 0.090 inch thick.

The locking assembly may be used in any orientation (such as on its side for awning windows) because the lock catch action is not dependent on gravity. The lock mechanism will force the lock catch to drop to its lowered and extended position.

Additional advantages of this invention include a locking system not requiring a special window frame configuration, but instead only requires special cuts in the frame and frame stop. The locking system requires relatively few parts, and most of the parts are universal such that they can be used for left-hand or right-hand locking systems. Any number of locking assemblies can be operated on a single jamb by only one handle. The locking assembly housing has projections that engage the frame and frame stop, thereby transferring the load required to hold the sash closed to the frame and frame stop and thereby avoid the installation screws carrying the full load.

DESCRIPTION OF THE PREFERRED EMBODIMENT

Figure 1:
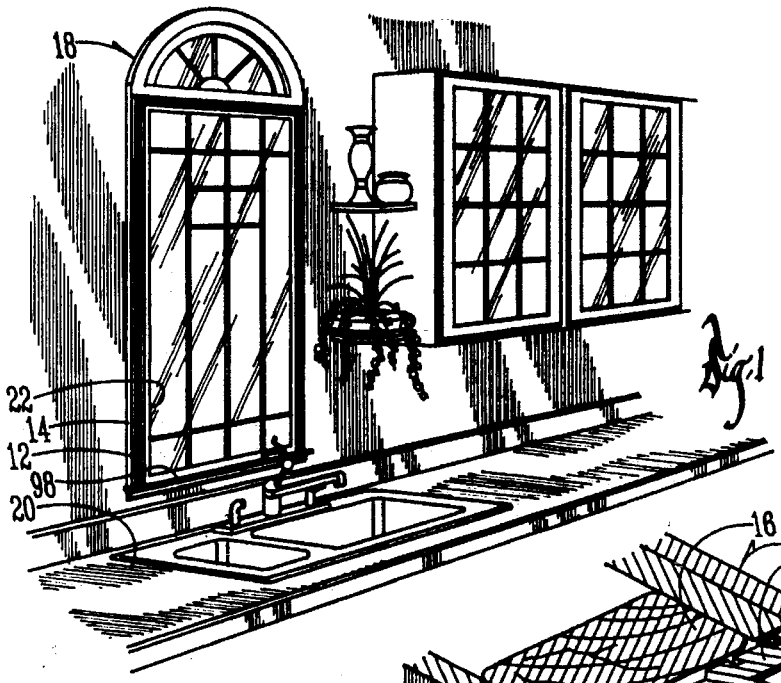
FIG. 1 is a fragmentary perspective view of a casement window including the locking system of this invention mounted over a kitchen sink.
Figure 2:
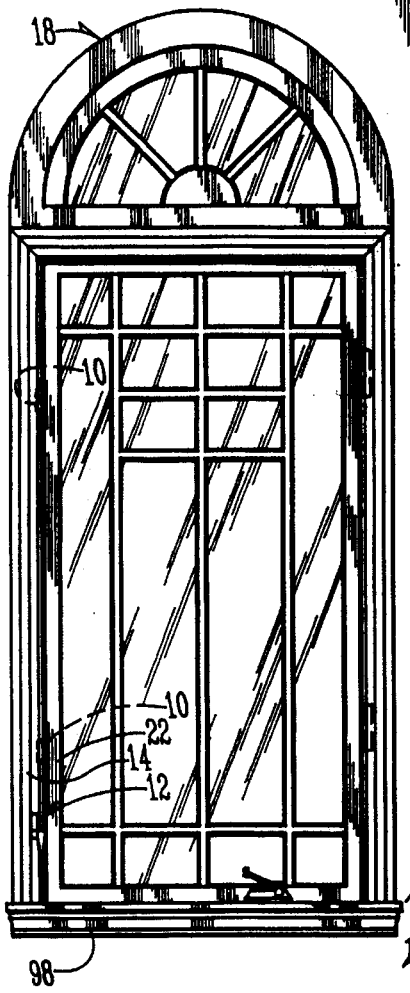
FIG. 2 is an enlarged elevational view of the window only.
Figure 3:
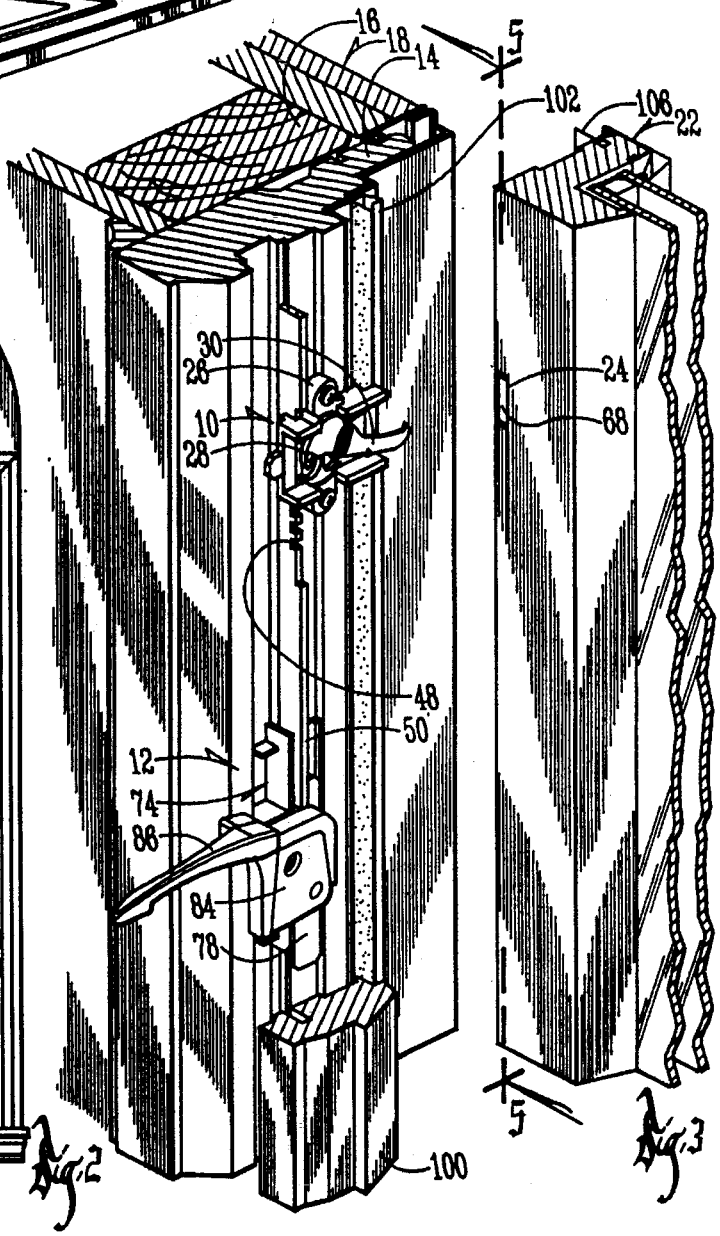
FIG. 3 is a fragmentary cross-sectional perspective view of the drive assembly, locking assembly mounted on a window frame jamb and lock strike on the sash.

The locking system of this invention as seen in FIG. 3 includes a locking assembly 10 and a drive assembly 12 mounted on a jamb 14 in a window frame 16. As seen in FIGS. 1 and 2, a window assembly 18 is mounted over a kitchen counter 20 and includes sash 22. The sash 22 includes a lock strike 24.

Figure 4:
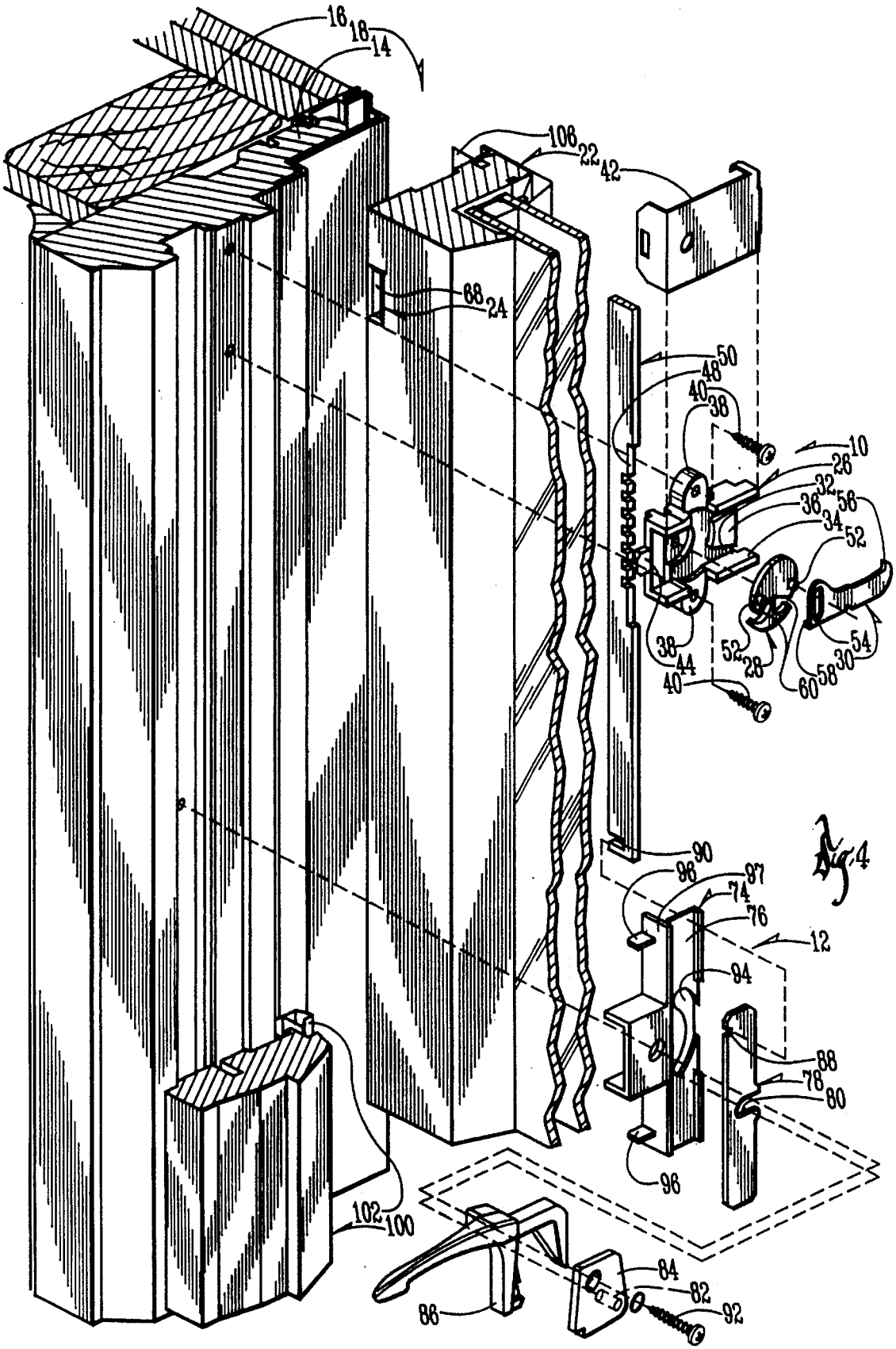
FIG. 4 is a view similar to FIG. 3, but with the component parts of the drive assembly and locking assembly being exploded.

The lock assembly 10 is seen in FIG. 4 to include a housing 26 which holds a lock cam 28 for operating a lock catch 30. The housing 26 is symmetrical in appearance and has a pair of lock catch 30 channels 32 as defined by oppositely disposed side walls 34 and a guide block 36. The housing 26 has ears 38 to receive screws 40 engageable with the jamb 14. A cap 42 may be snapped over the housing 26. A positioning tab 44 extends from the housing 26.

The lock cam 28 is circular in shape and includes a gear 46 on its bottom side for engagement with a rack 48 on a link 50. The top face of the lock cam 28 includes oppositely disposed pins 52 for engagement with the lock catch 30 in a vertical slot 54. The lock catch 30 includes an outer end 56 having a hook opposite the inner end having the elongated vertical slot 54. A longitudinally extending flange 58 extends along the bottom side of the lock catch 30 and is received in one or the other of the channels 32 of the housing 26. Flange 58 is also received in the right side slot of a pair of oppositely disposed slots 60 extending from the periphery of the lock cam 28 inwardly.

Figure 5:
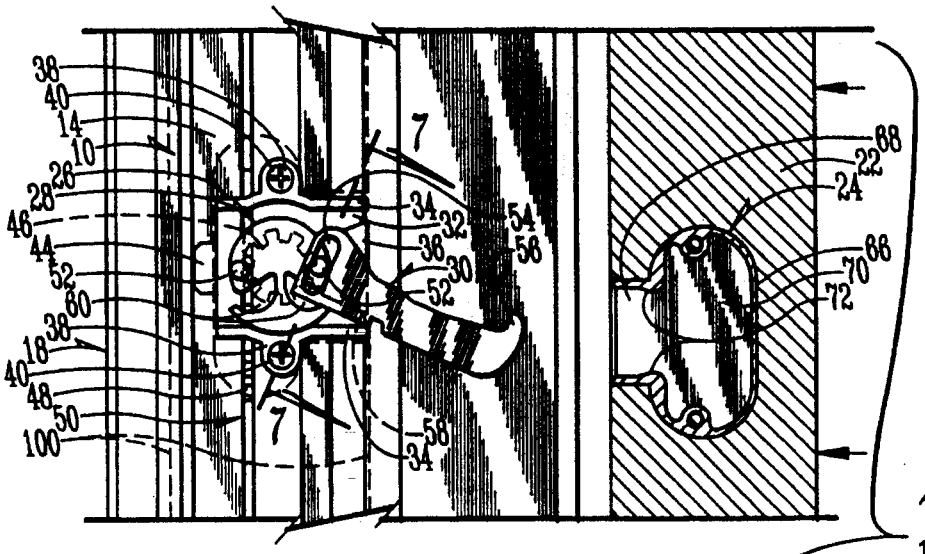
FIG. 5 is a cross-sectional view taken along line 5—5 in FIG. 3 showing the lock catch in its first position extending downwardly and outwardly.
Figure 5A:
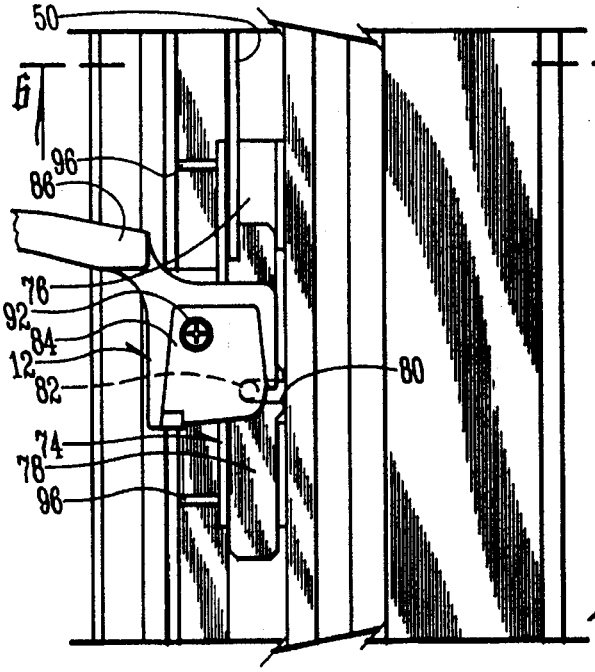
FIG. 5A is a view similar to FIG. 5, but showing the locking assembly removed from the jamb.
Figure 5A:
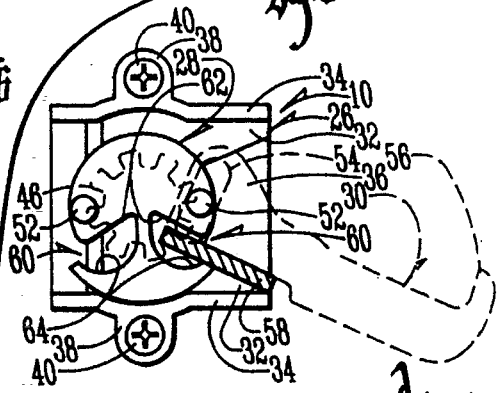
Figure 7:
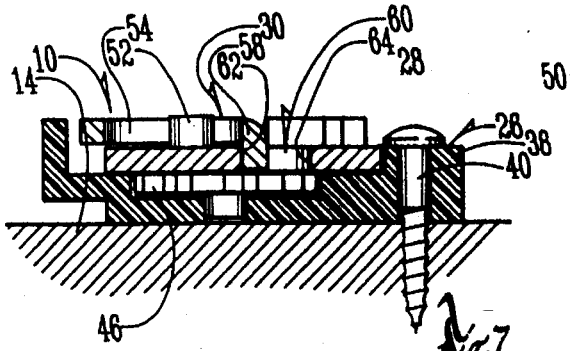
FIG. 7 is a cross-sectional view taken along line 7—7 in FIG. 5.
Figure 6:
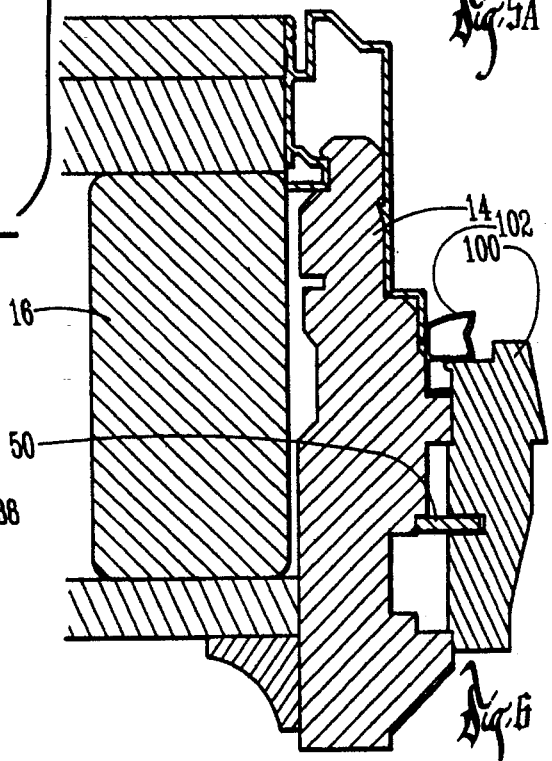
FIG. 6 is a cross-sectional view taken along line 6—6 in FIG. 5.
Figure 8:
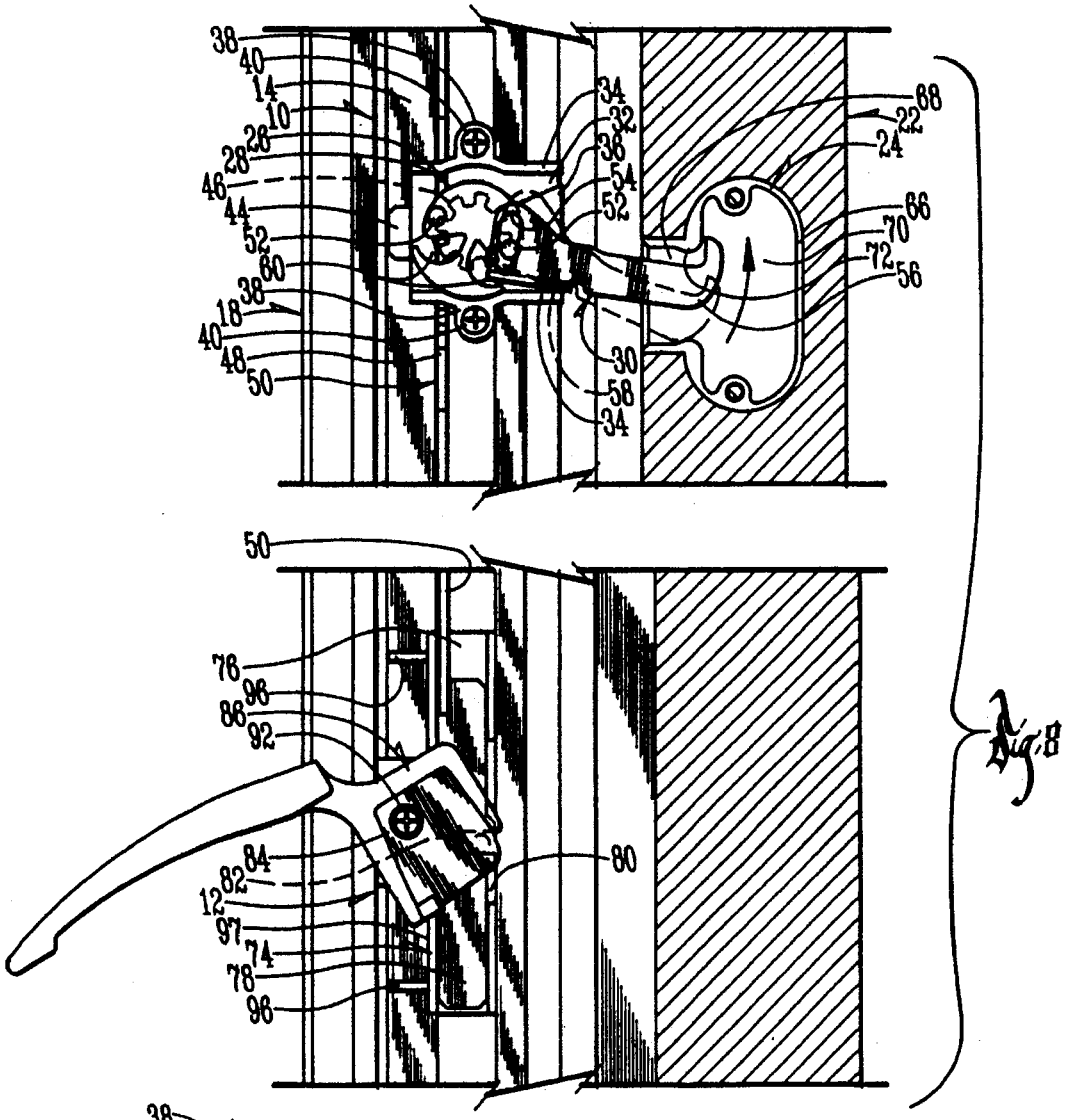
FIG. 8 is a view similar to FIG. 5, but showing the lock catch having been pivoted from its first position towards its second position in engagement with the lock strike on the sash for lifting it before pulling it to a closed position.
Figure 9:
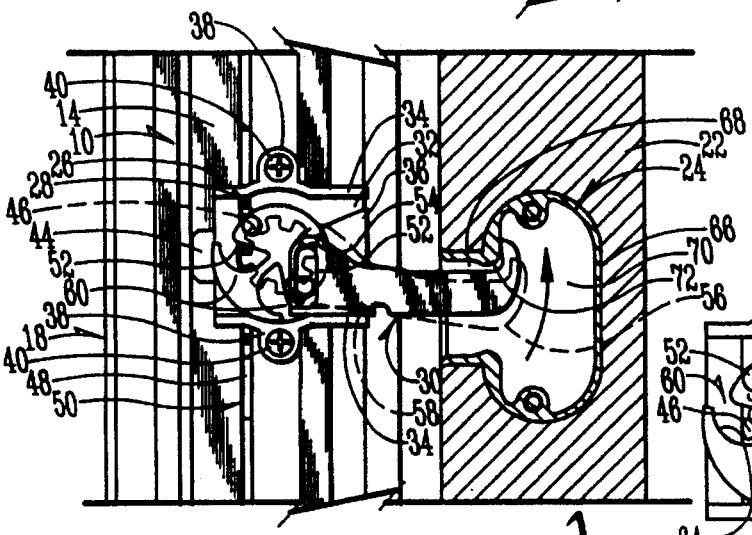
FIG. 9 is a view similar to FIG. 8, but showing the lock catch having completed its upward travel and ready to be moved horizontally for closing the sash.
Figure 9A:
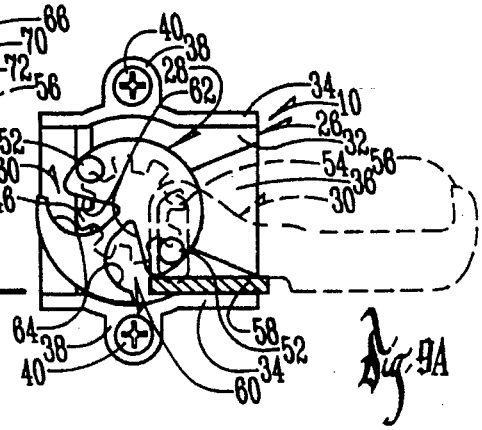
FIG. 9A is a view similar to FIG. 9, but showing the locking assembly removed from the frame jamb.
Figure 10:
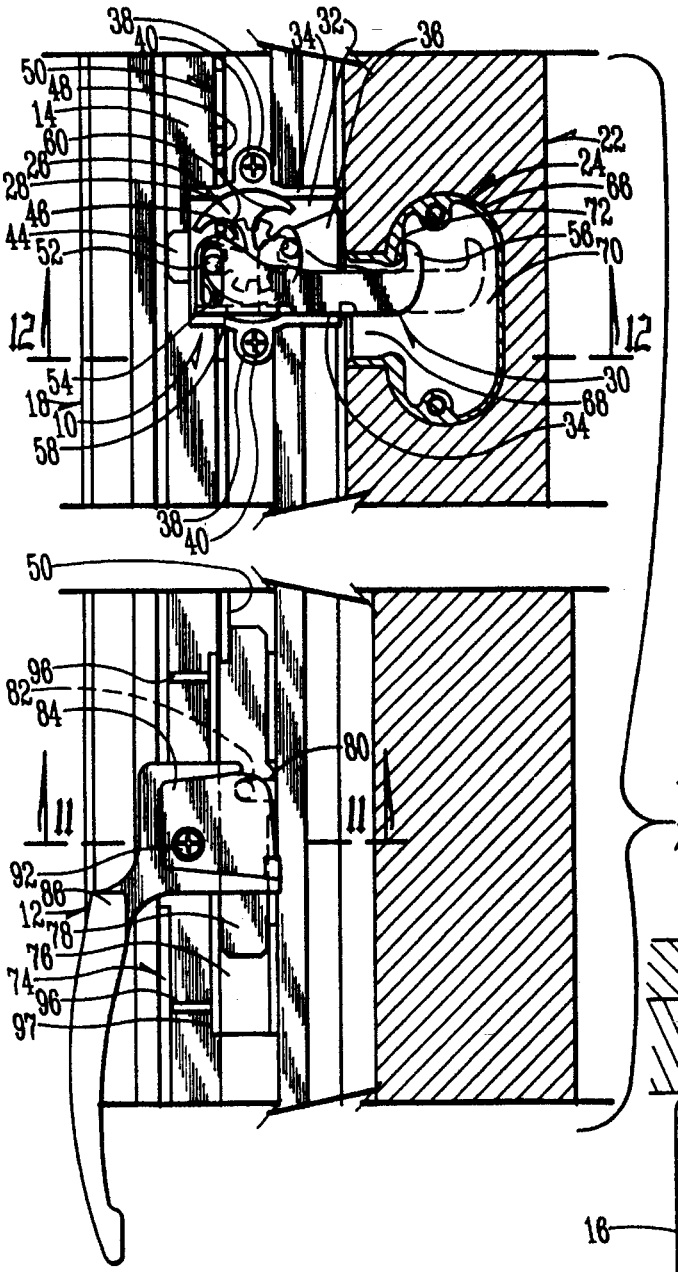
FIG. 10 is a view similar to FIG. 9, but showing the lock catch having moved horizontally inwardly for pulling the sash to a fully-closed position.
Figure 10A:
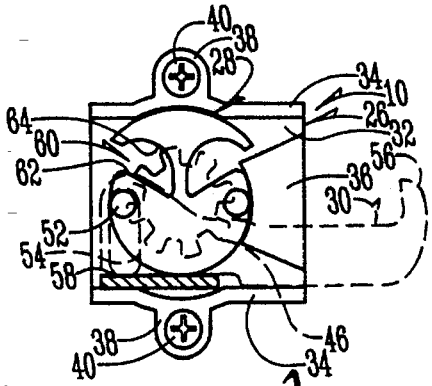
FIG. 10A is a view of the locking assembly of FIG. 10 removed from the window frame jamb.
Figure 11:
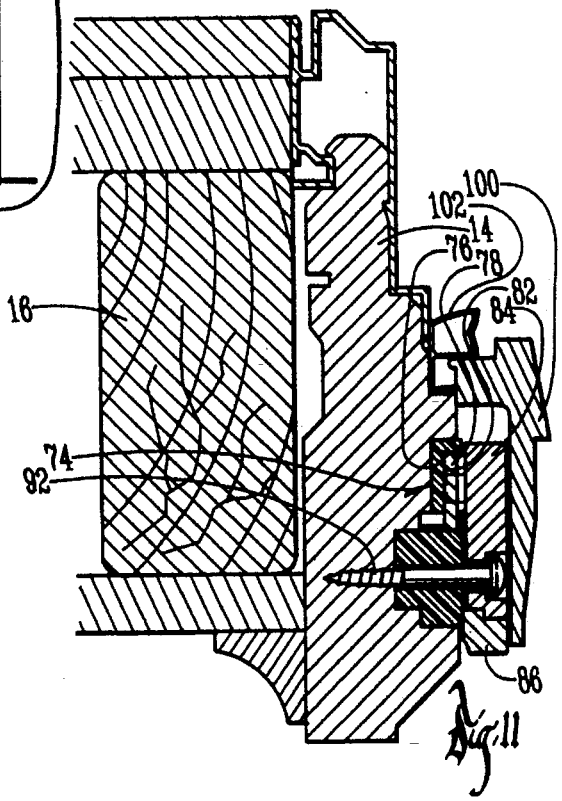
FIG. 11 is a cross-sectional view taken along line 11—11 in FIG. 10.

The sequential operation of the lock assembly 10 is seen in FIGS. 5, 8 and 10. In FIG. 5 the lock catch 30 extends downwardly and outwardly in a first position. As the lock cam 28 is rotated clockwise as seen in FIG. 8, the upper wall 62 of the right-hand cam slot 60 presses down on the flange 58 below the vertical slot 54 causing the lock catch 30 to pivot upwardly at its hook end 56. The fulcrum for the pivoting of the lock latch 30 is the point of contact of the flange 58 with the housing channel 32 bottom wall 34. As the lock cam 28 continues to rotate clockwise as seen in FIG. 10, the pin 52 operating in the slot 54 pulls the lock latch 30 horizontally inwardly to the left. The maximum inward travel is reached when the pin 52 reaches the nine o'clock position.

Figure 13:
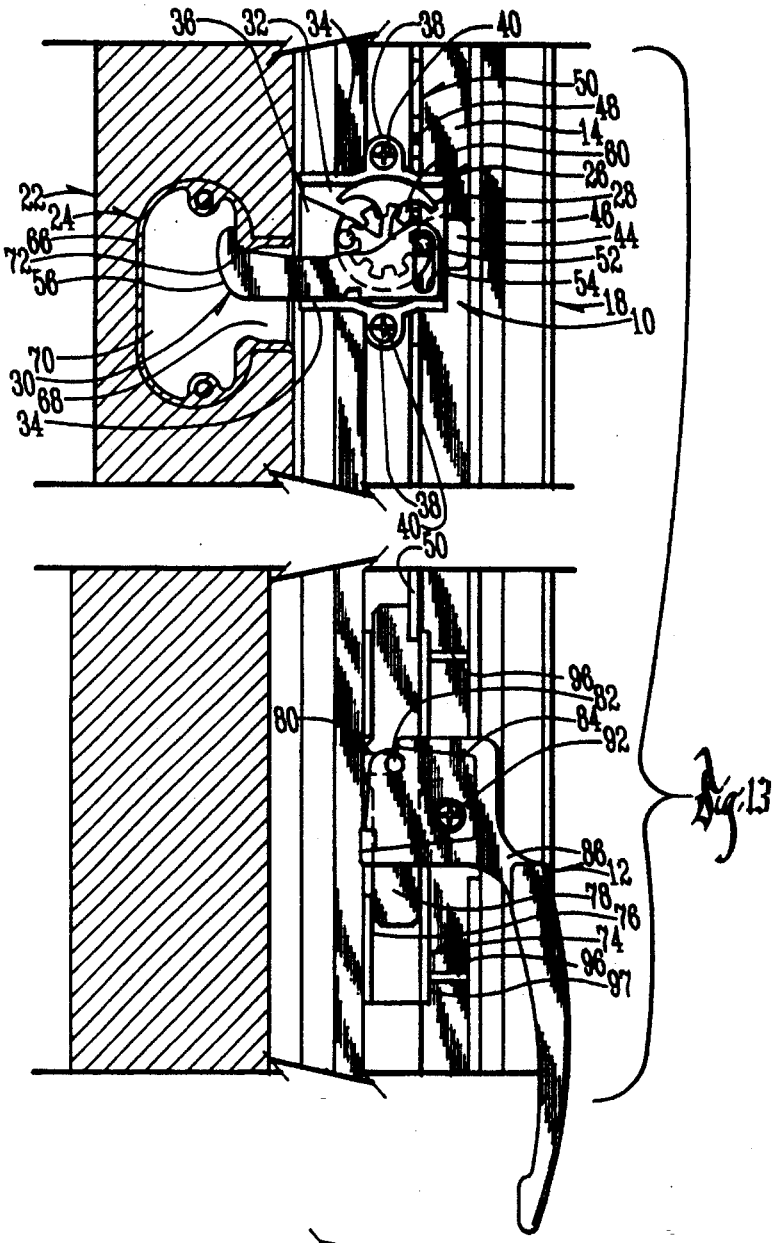
FIG. 13 is a view similar to FIG. 10, but showing the drive assembly and locking assembly mounted on the opposite window frame jamb in engagement with a lock strike mounted on the opposite vertical end edge of the sash.
Figure 14:
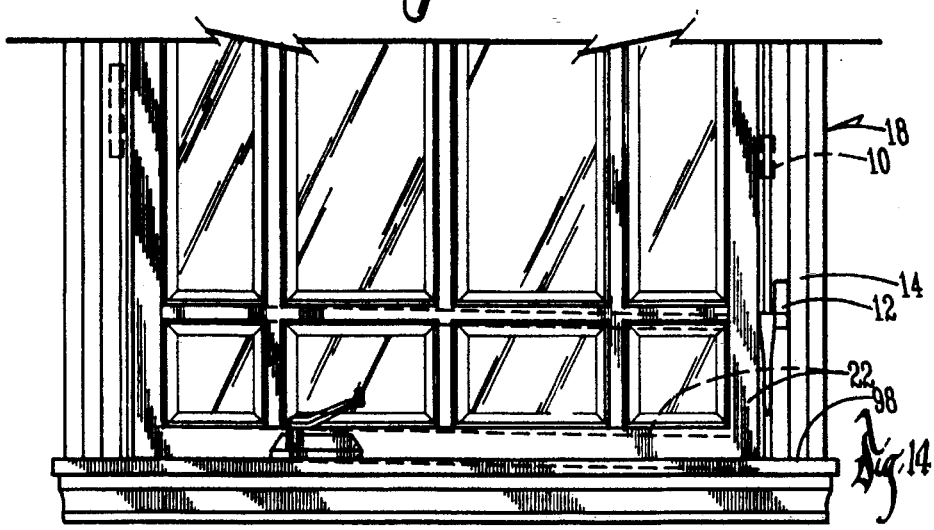
FIG. 14 is a fragmentary elevational view of the window of FIG. 13 and also shows in dash lines the window before being raised by the locking assembly.

The unlocking of the lock assembly is accomplished by rotating the lock cam 28 in a counter clockwise direction whereupon the bottom wall 64 of the slot 60 on the right-hand side of the lock cam 28 as seen in FIG. 5 presses upwardly on the bottom side of the flange 58 while the adjacent sidewall of the guideblock 36 in the housing 26 forming the channel 32 presses downwardly on the top side of the flange 58 insuring that the catch 30 returns to its original position shown in FIG. 5. Thus it is seen that in moving from a fully open position of FIG. 5 to a fully closed position of FIG. 10 the lock cam 28 rotates 180° with the pin 52 moving from a three o'clock position to a nine o'clock position. The oppositely disposed cam slot 60 and pin 52, along with the opposite housing channel 32 are used when the locking assembly 10 is mounted on the opposite jamb 14A as seen in FIGS. 13 and 14.

The lock strike 24 includes a housing 66 having an access opening 68 to an interior chamber 70. A pair of shoulders 72 are disposed on opposite sides of the access opening 68 for engagement by the hook end 56 of the lock catch 30. As seen in FIGS. 1–12, the hook 56 engages the upper shoulder 72. When the lock strike housing 66 is mounted on the opposite edge of the sash 22 as seen in FIGS. 13 and 14, the lower shoulder 72 becomes the upper shoulder. The lock strike housing 66 is recessed into the outer vertical end edge of the sash 22 giving a flush appearance to the end edge and the interior surface of the sash.

The drive assembly 12 includes a housing 74 having a vertical channel 76 in which a plate element 78 is received. The plate 78 includes a transversely extending slot 80 which receives a pin 82 on the bottom side of a drive handle cam 84. A handle 86 is detachably connected to the cam 84 for rotating the cam and in turn causing upward and downward travel of the plate element 78 which in turn is connected through a notch 88 to a notch 90 in the lower end of the link 50 having the rack 48. A screw 92 extends through the cam 84 and the housing 74 to secure the drive assembly 12 to the frame jamb 14. An arcuate slot 94 in the housing 74 receives the free end of the pin 82 on the drive handle cam 84. A pair of strengthening and positioning tabs 96 are provided on the housing 74 to support the side 97 of the channel 76 in the housing 74.

As seen in FIG. 2, a pair of lock assemblies 10 are operated by a single drive assembly 12 located adjacent a windowsill 98, thus placing the handle 86 in a position convenient for being reached over the counter 20.

The locking system of this invention allows for the window jamb 14 to be manufactured in quantity without special routing being required to accommodate the lock assembly 10 or the drive assembly 12. The shoulders and slots in these component pieces are such that they will accommodate these assemblies at any point along their length and thus will be mounted to the jamb 14 with the lock assemblies being in alignment with the lock strikes 24.

Figure 12:
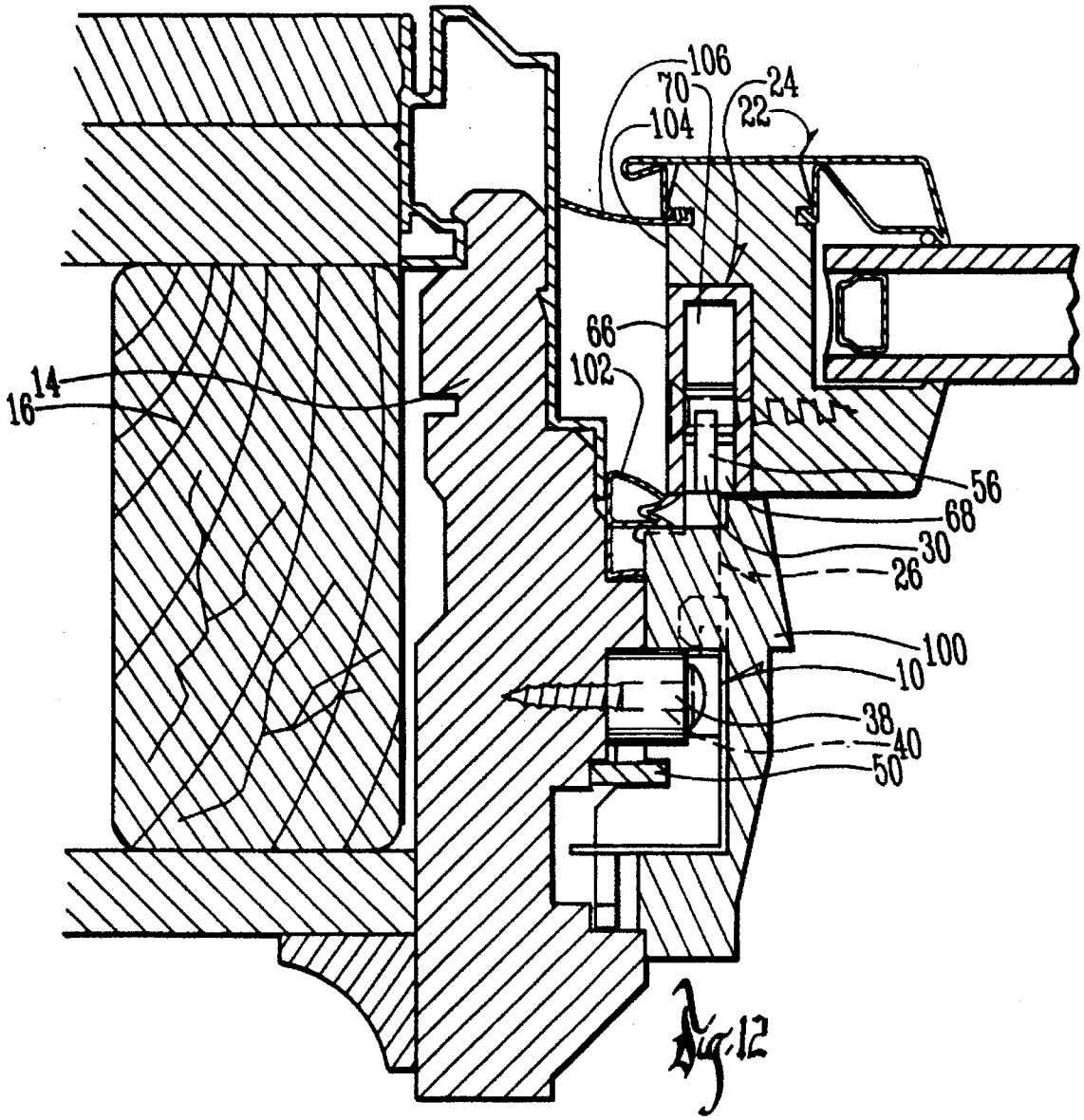
FIG. 12 is a cross-sectional view taken along line 12—12 in FIG. 10.

The lock assembly 10 and drive assembly 12 are hidden under a very thin frame stop 100 as seen in FIG. 12. The frame stop 100 is routed out to provide recesses for receiving the lock assembly 10 and drive assembly 12. It is further seen in FIG. 12 that a primary weather seal 102 is provided on the jamb 14 which engages the outer end edge 104 of the sash 22, and since the outer wall of the lock strike housing 66 is coincident with the sash outer end edge 104, a continuous seal is provided. A secondary rain strip seal 106 is also provided on the frame jamb 14 for engagement with the outer end edge 104 of the sash 22.

It is understood that alternate drive assembly arrangements can be utilized wherein the drive handle cam 84 is connected directly to the link 50 for operating the lock cam 28.

Figure 15:
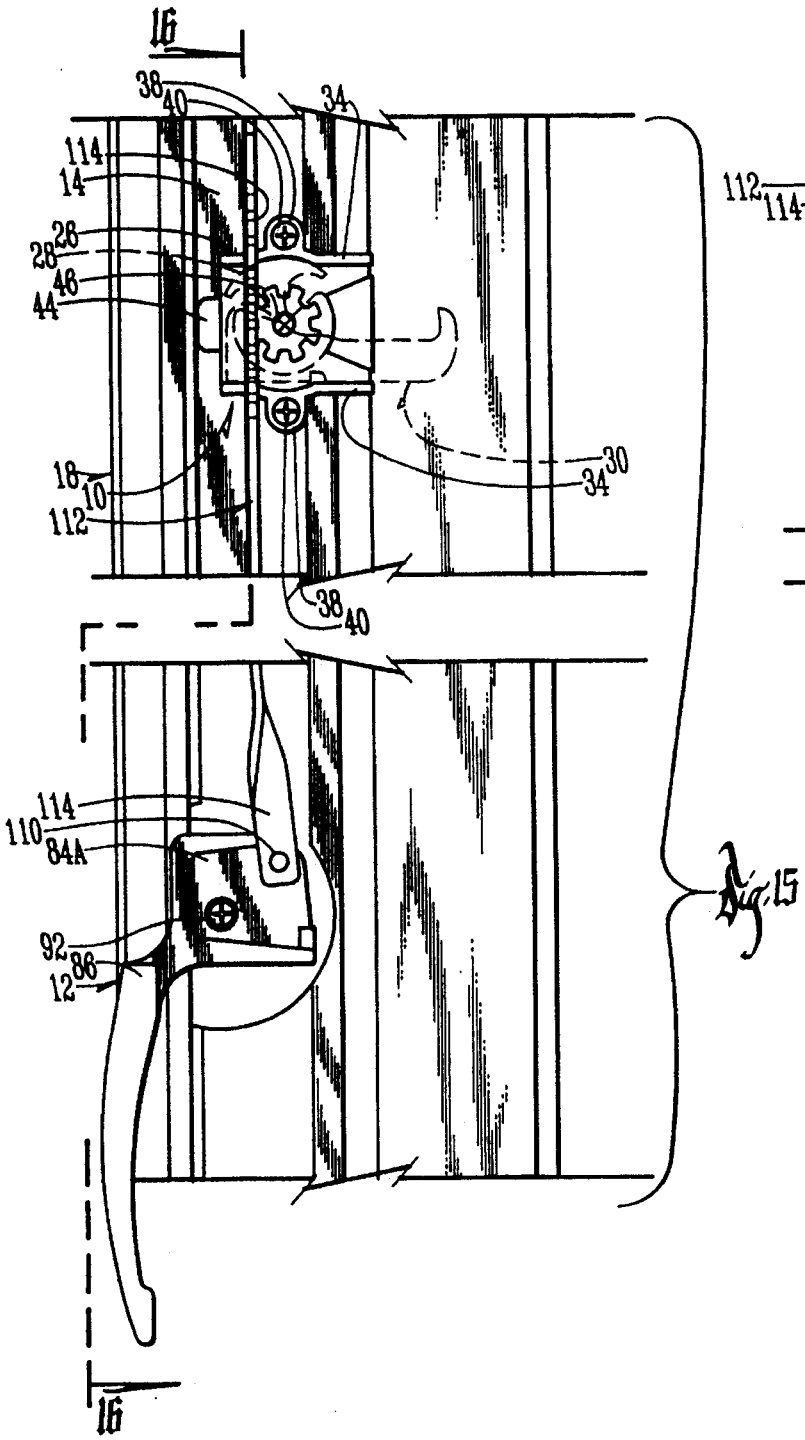
FIG. 15 illustrates an alternative drive assembly for operating the lock assembly.
Figure 16:
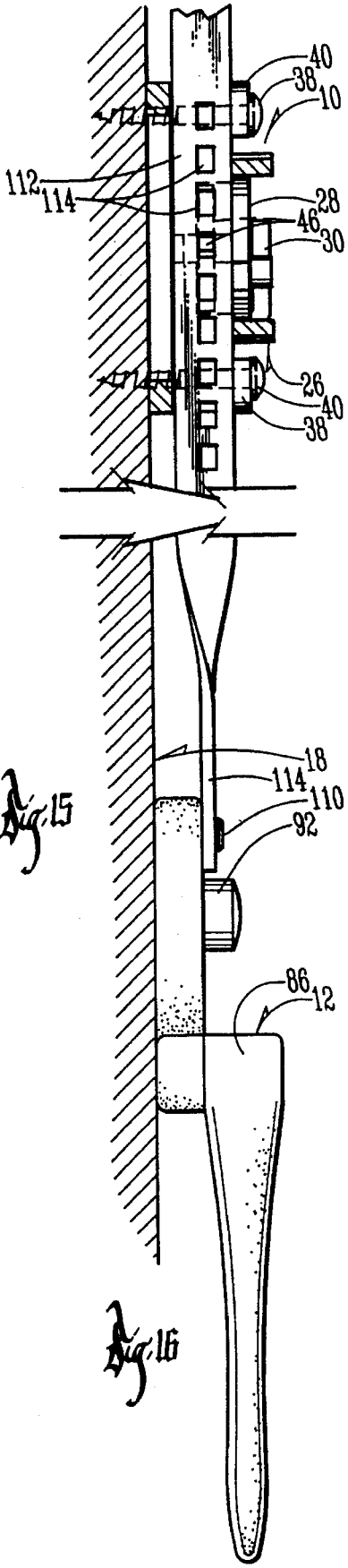
FIG. 16 is a cross-sectional view taken along line 16—16 in FIG. 15.

In FIGS. 15 and 16 an alternate drive assembly is shown. The drive cam 84A includes a pin 110 which connects it directly to a rack plate link 112 through an end 114 which is twisted 90 degrees to allow flexing as it is operated. The rack teeth on the plate link 112 are in the form of spaced apart holes 114 along the longitudinal center of the plate link. Locating the rack teeth 114 along the center allows for a thinner or weaker material to be used.

What is claimed is:

1. A locking assembly comprising, a housing having an outwardly extending channel defined by oppositely disposed guide surfaces, a cam rotatably mounted about an axis of rotation in said housing and including top and bottom faces, and an outer peripheral edge, an upwardly extending pin on said top face, and a slot extending from said periphery inwardly and defined by oppositely disposed guide edges, an elongated catch having a longitudinal axis and inner and outer ends, top and bottom sides and a longitudinally extending flange having opposite sides being perpendicular to said top and bottom sides, said outer end having a hook means and said inner end having a slot extending transversely to said longitudinal axis, and said catch having said flange positioned in said channel with said pin being received in said catch slot, said catch flange being positioned to engage the outer peripheral edge of said cam and extend into said cam slot at times during rotation of said cam.

2. The locking assembly of claim 1 wherein rotation of said cam causes said hook means to move from an outwardly and downwardly extending position to an inwardly and upwardly extending position.

3. The locking assembly of claim 2 wherein said cam pin is positioned adjacent to said housing channel when said hook means is in said outwardly and downwardly extending position and is positioned on the opposite side of the axis of rotation when said hook means is in said inwardly and upwardly extending position.

4. The locking assembly of claim 3 wherein when said hook means is in said outwardly and downwardly extending position said cam pin is adjacent to one of said cam slot guide edges, the other of said cam slot guide edges engages the adjacent side of said catch flange and the other side of said catch flange is engaged by one housing guide wall which is adjacent thereto, whereby said other cam slot guide edge moves the inner end of said catch upwardly as said catch outwardly therefrom is limited in upward movement by said one housing guide wall.

5. The locking assembly of claim 1 wherein said outwardly extending housing channel is one of two such channels, said upwardly extending pin on said cam is one of two such pins which are on opposite sides of said axis of rotation, and said slot in said cam is one of two such slots which are on opposite sides of said axis of rotation.

6. The locking assembly of claim 1 and said cam includes a gear on said bottom face, and a drive means engages said gear for rotating said cam.

7. The locking assembly of claim 6 wherein said drive means is a rack.

8. The locking assembly of claim 7 wherein said rack is included in a drive assembly which further includes a drive housing adapted to be mounted on a window jamb, an elongated drive plate is moveable in a channel in said drive housing, said drive plate includes means connecting it to said rack, a drive cam is rotatably mounted in said drive housing and engages said drive plate to move said drive plate in said channel.

9. The locking assembly of claim 8 wherein said drive cam includes a pin which is received in a slot on said drive plate whereby rotation of said cam moves said drive plate.

10. The locking assembly of claim 9 wherein said rack is further defined as an elongated plate and is positioned in a plane perpendicular to a plane containing said drive plate.

11. The locking assembly of claim 10 and a handle means is detachably connected to said drive cam.

12. The locking assembly of claim 10 and said drive cam is in a plane parallel to said drive plate.

13. The locking assembly of claim 12 and said gear on said lock cam is in a plane perpendicular to said rack plate.

14. The locking assembly of claim 7 wherein said locking assembly is one of at least two locking assemblies connected to said rack.

15. The combination of a window and locking assembly, the window having a frame including a jamb and a frame stop, and a sash having interior and exterior sides and an outer edge, said sash being hinged to said frame and being moveable between open and closed positions, said locking assembly comprising, a lock strike on the interior side of said sash, a lock housing on said jamb adjacent said lock strike when said sash is in said closed position, an elongated catch in said housing and having inner and outer ends, said outer end having a hook means for engagement with said lock strike, drive means connected to said catch for moving said hook means from a first position extending outwardly and downwardly to a second position extending upwardly and withdrawn inwardly, whereby said hook means, in moving between said first and second positions is adapted to lift up on said lock strike and then pull said lock strike toward said jamb to said sash closed position.

16. The structure of claim 15 wherein said lock strike is further defined as including a housing having an access opening and an interior shoulder engageable by said catch hook means through said access opening.

17. The structure of claim 16 wherein said sash has an outer free edge between said interior and exterior sides and opposite said hinge, and said lock strike housing is inset into said outer free edge thereby presenting flush free edge and interior surfaces.

18. The structure of claim 15 wherein said lock strike is one of two lock strikes spaced apart on said sash, and said drive means includes a handle positioned below both of said two lock strikes.

19. The structure of claim 16 wherein said shoulder is one of two shoulders spaced apart on opposite sides of said access opening.

20. The structure of claim 19 wherein one of said lock strike shoulders is an upper shoulder and the other shoulder is a lower shoulder, and said hook means engages said upper shoulder.

21. A casement window lock strike comprising, a housing having an access opening on one side in communication with an interior chamber defined by a wall having strike shoulders on opposite sides of said access opening, said housing being adapted to be recessed into either of oppositely disposed vertical end edges of a sash whereby an upwardly facing lock catch hook will engage one strike shoulder when said housing is on one of said vertical edges and engage the other strike shoulder when said housing is on the other of said vertical edges.

* * * * *